United States Patent [19]

Shimodaira

[11] 4,408,911

[45] Oct. 11, 1983

[54] INK RIBBON WINDING AND REVERSING ASSEMBLY

[75] Inventor: Tadayoshi Shimodaira, Shiojiri, Japan

[73] Assignee: Epson Corporation, Nagano, Japan

[21] Appl. No.: 905,915

[22] Filed: May 15, 1978

[30] Foreign Application Priority Data

May 13, 1977 [JP] Japan ..... 52-55104

[51] Int. Cl.[3] ..... B41J 35/28; B41J 33/50

[52] U.S. Cl. ..... 400/208; 400/219.3

[58] Field of Search ..... 400/219–219.4, 400/208, 220.1, 194–196

[56] References Cited

U.S. PATENT DOCUMENTS

| | | | |
|---|---|---|---|
| 3,899,065 | 8/1975 | Brignole | 400/219.2 X |
| 3,910,399 | 10/1975 | Shimodaira | 400/219.3 |
| 4,033,445 | 7/1977 | Oddicini | 400/219.3 X |
| 4,083,444 | 4/1978 | Salto | 400/219.3 X |

*Primary Examiner*—Paul T. Sewell

*Attorney, Agent, or Firm*—Blum, Kaplan, Friedman, Silberman and Beran

[57] ABSTRACT

An ink ribbon winding and reversing assembly suitable for use in a printer having two ratchet wheels for winding ink ribbon spools and an ink ribbon cassette having two rotatably mounted ink ribbon spools is provided. The assembly includes a feeding lever formed with opposed pawls for driving a first ratchet wheel in a first winding direction in response to displacement of the feeding lever. A detecting lever formed with a central arm disposed between the spools is biased towards the unwinding spool and causes the feeding lever to be displaced toward the unwinding spool at completion of winding thereon in response to the feeding lever shifting engagement to drive the second spool. This reversal process is repeated at completion of winding in each direction. The central arm of the detecting lever is formed with lateral guide surfaces for permitting engagement of an ink ribbon spool and an ink ribbon cassette with the detecting layer in a single snap-in motion.

26 Claims, 5 Drawing Figures

INK RIBBON WINDING AND REVERSING ASSEMBLY

BACKGROUND OF THE INVENTION

This invention relates generally to an ink ribbon winding and reversing device for use in a printer, and particularly to an ink ribbon winding and reversing assembly suitable for use with an ink ribbon cassette having two ink ribbon spools rotatably mounted therein. In conventional printers having ink ribbon winding assemblies, including printers accepting ink ribbon cassettes, it is difficult to insert an ink ribbon spool or ink ribbon cassette in a single motion. In conventional ink ribbon printers accepting ink ribbon cassettes, it is often difficult to attach the ink ribbon cassette to the printer properly. During insertion of the cassette the operator often must move several levers and always faces the possibility of improper insertion and handling of the ink ribbon. When the ink ribbon is handled, the operators often get ink on their hands or may dammage the mechanism. Accordingly, it is desirable to provide an ink ribbon winding assembly which is trouble-free, suitable for use with an ink ribbon cassette and which permits an ink ribbon spool or ink ribbon cassette to be inserted with a single trouble-free movement.

SUMMARY OF THE INVENTION

Generally speaking, in accordance with the invention, an ink ribbon winding and reversing assembly for use in a printer utilizing an ink ribbon wound on conventional ink ribbon spools and for use with printers adapted to receive an ink ribbon cassette having two rotatably mounted ink ribbon winding spools therein is provided. The ink ribbon winding and reversing assembly includes a pair of ink ribbon spools mounted on two rotatably mounted ratchet wheels spaced apart from each other. A feeding lever formed with two opposed feeding pawls is disposed between the ratchet wheels and is adapted to be displaced for driving said ratchet wheels for winding the ratchet wheel and an associated ribbon spool in its winding direction. A rotatably mounted anti-reversal lever formed with a pair of opposed anti-reversal pawls is rotatably mounted between the ratchet wheels and adapted to engage the ratchet wheel of the winding spool for preventing reversal of the winding spool. A rotatably mounted detection lever formed with a central arm disposed between the spools is adapted to detect the amount of ink ribbon remaining on the ink ribbon spool associated with the unwinding ratchet wheel and is formed further with two wing portions. At completion of winding, one of the wing portions enters the locus of a reversing pawl formed on the feeding member, rotating the feeding lever into engagement with the other ratchet wheel for driving the other ratchet wheel which becomes the winding wheel. Rotation of the feeding lever causes rotation of the anti-reversal lever and a shift of the detecting lever for determining the end of winding in the new winding direction.

The assembly is particularly well-suited for use in printers adapted to receive an ink ribbon cassette having a pair of rotatably mounted ink ribbon spools spaced apart therein. A cassette is inserted into the printer onto the ink ribbon base plate so that the ink ribbon spools cooperated with the ratchet wheels. The central arm of the detecting lever is formed with opposed edge guide surfaces for receiving the ink ribbon cassette in a single smooth placement operation.

Accordingly, it is an object of the invention to provide an improved ink ribbon winding and reversing assembly.

Another object of the invention is to provide an improved ink ribbon winding and reversing assembly suitable for use with ink ribbon cassettes.

A further object of the invention is to provide an ink ribbon winding and reversing assembly having an improved detecting lever for detecting completion of winding in one direction.

Still another object of the invention is to provide an improved ink ribbon winding and reversing assembly adapted to receive an ink ribbon cassette in a single attachment step.

Another object of the invention is to provide an improved ink ribbon winding and reversing assembly of simple construction, which can be readily miniaturized for use in small sized printers.

Still other objects and advantages of the invention will in part be obvious and will in part be apparent from the specification.

The invention accordingly comprises the features of construction, combination of elements, and arrangement of parts which will be exemplified in the construction hereinafter set fourth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
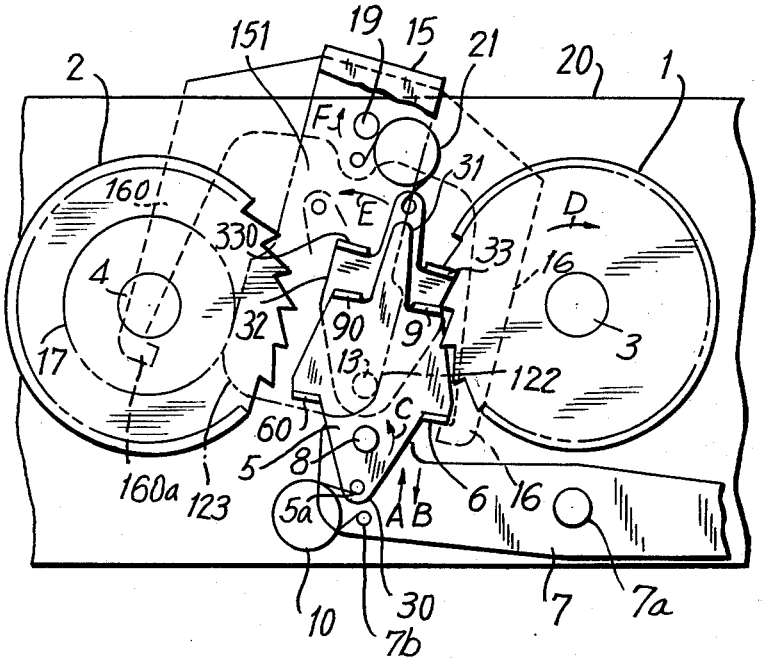
FIG. 1 is a top plan view illustrating an ink ribbon winding and reversing assembly constructed and arranged in accordance with the invention.

Referring now to FIG. 1, an ink ribbon winding and reversing assembly constructed and arranged in accordance with the invention, is shown. A first ratchet wheel 1 and a second ratchet wheel 2 are rotatably mounted on a central shaft 3 and a central shaft 4, respectively, which are mounted on a ribbon base plate 20. A feeding lever 5 disposed between ratchet wheel 1 and ratchet wheel 2 is formed with a first feeding pawl 9 adapted to engage ratchet wheel 1 and an opposed second feeding pawl 90 adapted to engage ratchet wheel 2 for driving ratchet wheel 2 in its respective winding direction.

Ratchet wheel 1 is wound in a clockwise direction as indicated by an arrow D. The ink ribbon is wound on an ink ribbon spool (not shown) associated with ratchet wheel 2 in a counterclockwise direction. Feeding lever 5 is pivotally mounted at one end to an elongated driving lever 7 by a pin 8. Driving lever 7 is rotatably mounted to ribbon base plate 20 by a shaft 7*a*. Feeding lever 5 is formed further with a first reversing pawl 6 and a second opposed reversing pawl 60 proximate pin 8 which are adapted to engage a portion of a detecting lever 15 at completion of winding in each direction. Feeding lever 5 is formed further with an elongated reversal pin 31 at its free end for transmitting rotation about pin 8 to an anti-reversal lever 32. The operation and function of reversing pawl 6 and second reversing pawl 60 and the operative engagement of the functioning levers will be described in more detail with respect to operation of the ribbon reversing operation set forth below.

Driving lever 7 is adapted to pivot reciprocatively about shaft 7*a* thereby causing feeding lever 5 to be displaced reciprocatively between a first position away from engagement with one of the ratchet wheels indicated by an arrow B and a second position in engagement with one of the ratchet wheels indicated by an arrow A for winding one of the ratchet wheels. A torsional coil spring 10 mounted between feeding lever 5 at a pin 5*a* and driving lever 7 at a pin 7*b* is adapted to bias feeding lever 5 towards ratchet wheel 1 as shown in FIG. 1. Following reversal of ribbon winding direction when feeding lever 5 has been rotated about pin 8, feeding lever 5 is biased towards engagement with ratchet wheel 2 by the biasing action of torsion coil spring 10.

Anti-reversal lever 32 is rotatably mounted to ribbon base plate 20 by a shaft 13 and is an elongated lever formed with a first anti-reversal pawl 33 and an opposed second anti-reversal pawl 330 for preventing reversal of the winding ratchet wheel during ribbon winding by replacement of feeding lever 5. Anti-reversal lever 32 is disposed so that reversal pin 31 of feeding lever 5 is disposed between first anti-reversal pawl 33 and second anti-reversal pawl 330 for rotating anti-reversal lever 32 about shaft 13 when feeding lever 5 is rotated about pin 8.

Figure 2:
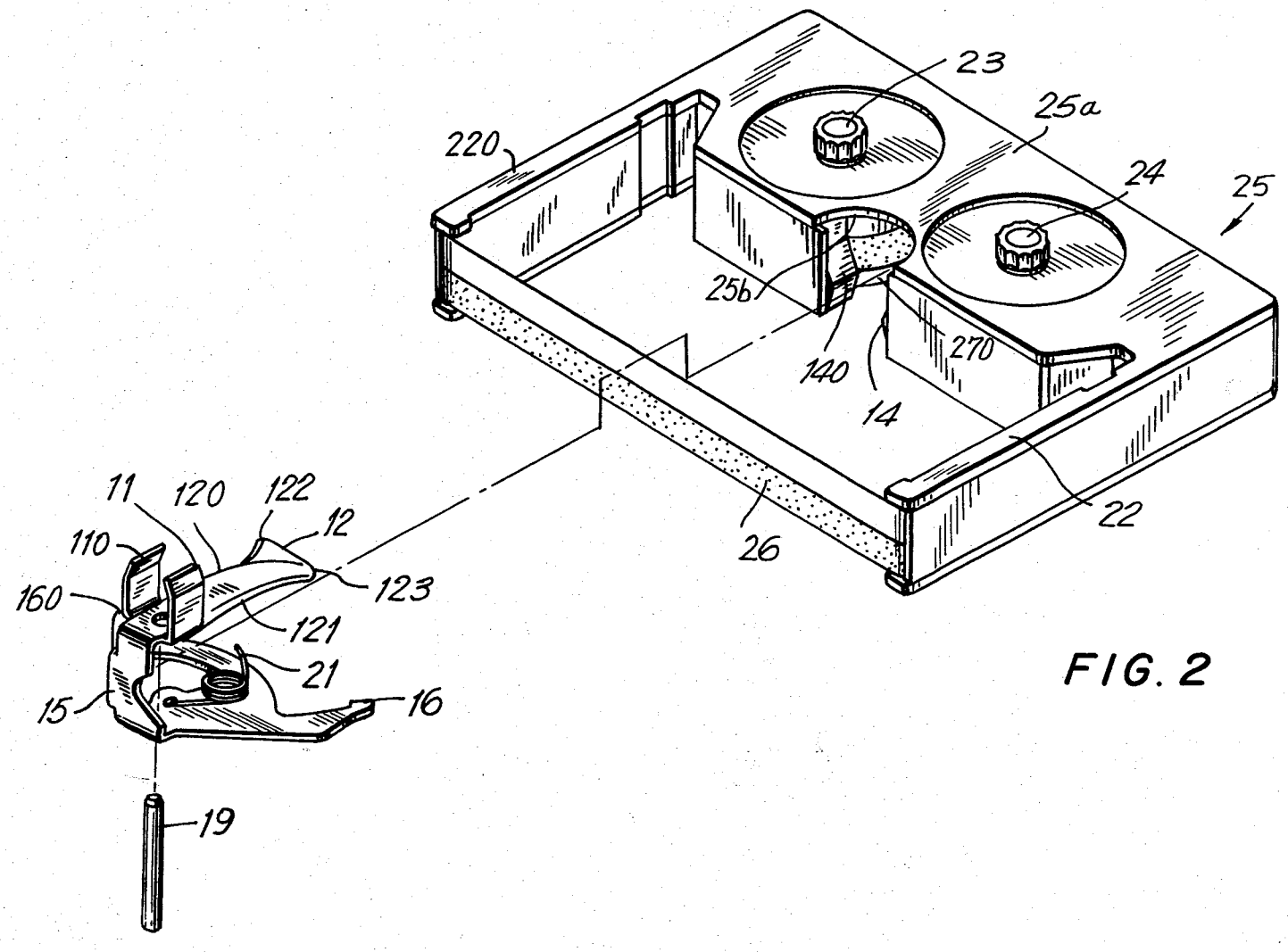
FIG. 2 is an exploded perspective view illustrating a detecting lever of the assembly of FIG. 1 and an ink ribbon cassette having two rotatably mounted ink ribbon spools therein engageable with the detecting lever.

A detecting lever 15 formed with an elongated central arm 12 and a first wing 16 and a second wing 160 is pivotally mounted on a shaft 19 to ribbon base plate 20. Detecting lever 15 is disposed on ribbon base plate 20 so that central arm 12 is disposed between ratchet wheel 1 and 2 and their respective winding spools. As shown in FIG. 2, central arm 12 of detecting lever 15 is formed with a first side edge ribbon-sliding portion 122 for contacting with and sliding on an outer surface of ribbon 17 wound on a ribbon spool associated with ratchet wheel 2. A second ribbon-sliding portion 123 is formed on the opposing side of central arm 12 for sliding on the outer surface of the ribbon wound on a ribbon spool associated with ratchet wheel 1 (not shown). A torsional coil spring 21 is mounted between detecting lever 15 and the free end of reversing lever 31 biasing detecting lever 15 towards unwinding ratchet wheel 2 as illustrated in FIG. 1. As detecting lever 15 is biased towards ratchet wheel 2 after reversal, second ribbon-sliding portion 123 is in contact with the outer ribbon surface of the ribbon wound on the ribbon spool associated with ratchet wheel 1.

As the ink ribbon is unwound from the ribbon spool associated with ratchet wheel 2 and detecting lever 15 is biased towards and rotates in a clockwise direction about shaft 19 as indicated by an arrow F. When unwinding from the ribbon spool associated with ratchet wheel 2 is complete, wing 16 enters into the locus of displacement of reversing pawl 6 of feeding lever 5 causing feeding lever 5 to pivot about pin 8 in a direction indicated by arrow C as will be more fully described with respect to the functioning of the ribbon winding and reversing assembly. After detecting lever 15 is rotated about shaft 19 towards ratchet wheel 2 and its associated ribbon spool which now becomes the winding spool, detecting lever 15 is biased towards ratchet wheel 1 by action of torsional coil spring 21 and first ribbon-sliding portion 122 rides along the outer surface of ribbon wound on the ribbon spool associated with ratchet wheel 1.

The ink ribbon winding and reversing assembly constructed and arranged in accordance with the invention as shown in FIG. 1 functions as follows. In FIG. 1, ratchet wheel 1 and its associated ink ribbon spool is shown as the winding spool. As driving lever 7 is pivotally reciprocated about shaft 7*a*, feeding lever 5 is displaced reciprocatively between its first position towards arrow direction B and its second position in engagement with ratchet wheel 1 in direction A. Driving pawl 9 engages the teeth on ratchet wheel 1 thereby driving ratchet wheel 1 in winding direction D.

Detecting lever 15 is biased towards ratchet wheel 2 by torsion coil spring 21 and ribbon-sliding portion 123 of central arm 12 rides along ribbon outer surface 17 unwinding from the ribbon spool associated with ratchet wheel 2. As winding in arrow direction D is completed, detecting lever 15 rotates about shaft 19 in direction F and the ribbon is unwound fully from the ribbon spool associated with ratchet wheel 2, first wing 16 is rotated in a clockwise direction until wing projection 16*a* enters the locus of reversing pawl 6 of reciprocating feeding lever 5. As feeding lever 5 is further displaced towards its first position towards direction B, reversing pawl 6 of feeding lever 5 engages wing projection 16*a* and feeding lever 5 is rotated about pin 8 in direction C. Reversing pin 31 of feeding lever 5 is rotated in direction C and contacts anti-reversal pawl 330 of anit-reversal lever 32 and anti-reversal lever 32 is rotated about shaft 13 in direction E. Feeding lever 5 and anti-reversal lever 32 are rotated in directions C and E, respectively, until feeding pawl 90 and anti-reversal pawl 330 engage the teeth of ratchet wheel 2 thereby driving ratchet wheel 2 in its counterclockwise winding direction as feeding lever 5 reciprocates towards its first position in direction B and its second position toward direction A. Feeding lever 5 is maintained in engagement with ratchet wheel 2 by the biasing action of torsion coil spring 10. Anti-reversal lever 32 is maintained in engagement with ratchet wheel 2 by the biasing action of torsion coil spring 21 after detecting lever 15 is rotated about shaft 19 as follows.

As the same time that feeding lever 5 and anti-reversal lever 32 are rotated in directions C and E, respectively, torsion coil spring 21 causes detecting lever 15 to rotate about shaft 19 in the counterclockwise direction towards ratchet wheel 1. Detecting lever 15 is biased toward ratchet wheel 1 by the biasing action of torsion coil spring 21. Ribbon-sliding portion 122 of central arm 12 rides along the outer surface of the ink ribbon unwinding from the ribbon spool associated with ratchet wheel 1. This reversal process and rotation of the respective levers is repeated each time the ink ribbon is unwound completely from the ink ribbon spool associated with the unwinding ratchet wheel.

Figure 3:
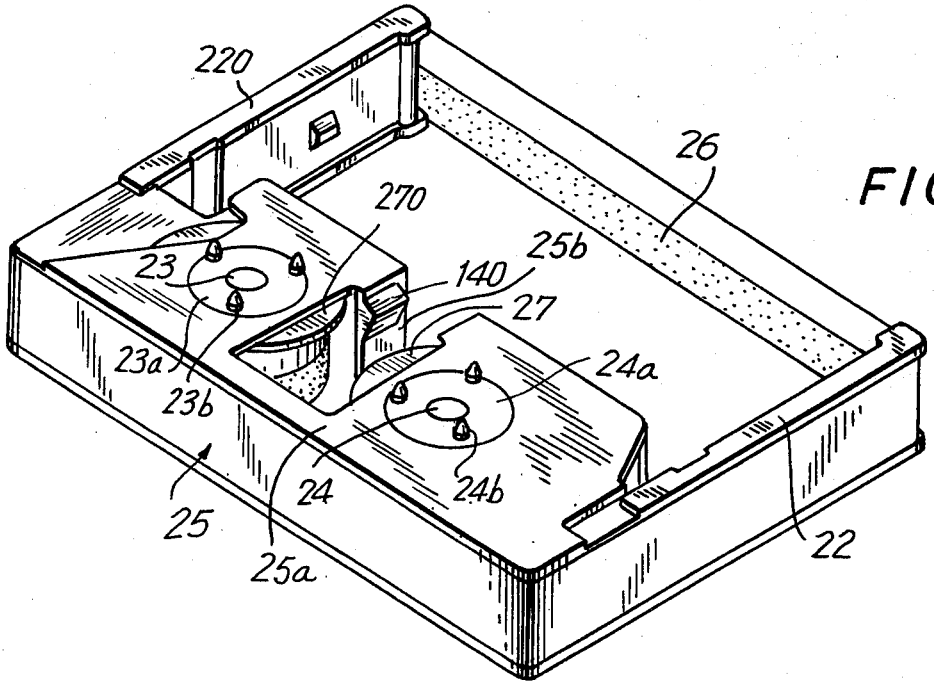
FIG. 3 is a perspective view illustrating the underside of the ink ribbon cassette shown in FIG. 2.

Referring specifically to FIG. 2, an exploded perspective view illustrating detecting lever 15 and shaft 19 and the position of engagement with an ink ribbon cassette 25 is shown. In FIG. 3, the underside of ribbon cassette 25 is shown. Ink ribbon cassette 25 includes an ink ribbon 26 with one end thereof fixed to a first ink ribbon spool 270 fixed to a first shaft 23 with the other end of ink ribbon 26 fixed to a second ink ribbon spool 27 fixed to a second shaft 24 shown in FIG. 3. The first ink ribbon spool 270 and second ink ribbon spool 27 are rotatably mounted in a cassette housing 25*a*. Ink ribbon 26 is threaded through cassette housing 25 from first ink ribbon spool 270 through a first elongated cassette arm 220 through a second elongated cassette arm 22, exposing a portion of ink ribbon 26 therebetween for printing, and then passing into ink ribbon cassette housing 25*a* to second ribbon spool 27. Shaft 23 is engageable with ratchet wheel 1 through center shaft 3 and shaft 24 is engageable with ratchet wheel 2 through center shaft 4. When ink ribbon cassette 25 is inserted onto ribbon base plate 20, first shaft 23 and second shaft 24 are rotated according to the respective winding direction of first ratchet wheel 1 and second ratchet wheel 2 for winding ink ribbon 26.

Referring specifically to FIG. 3, first shaft 23 is formed with an associated shaft plate 23*a* formed with a plurality of projections 23*b* for engaging with opening (not shown) formed in first ratchet wheel 1 for imparting the winding direction of first ratchet wheel 1 to first shaft 23 and its associated ink ribbon spool 270. Similarly, second shaft 24 is formed with an associated shaft plate 24*a* formed with a plurality of projections 24*b* for cooperating with openings (not shown) formed in second ratchet wheel 2 for imparting the rotational direction of second ratchet wheel to second shaft 24 and its associated ribbon spool 27.

Referring now to FIG. 2, ink ribbon cassette 25 may be mounted on ribbon base plate 20 by a single attaching movement as follows. When ink ribbon cassette 25 is inserted, first shaft 23 and second shaft 24 of cassette 25 are inserted on first shaft and center shaft 3 and second center shaft 24, respectively, and engaged with ratchet wheels 1 and 2, respectively, by projections 23*b* and 24*b*, respectively. At this time the position of detecting lever 15 may prevent easy insertion of ink ribbon cassette 25. For example, detecting lever 15 is biased towards center shaft 3 or center shaft 4 by a biasing force of torsion coil spring 21. Therefore, when ribbon cassette 25 is attached to ribbon base plate 20, a portion of ink ribbon cassette housing 25*a* may impinge against a portion of central arm 12 of detecting lever 15 and easy insertion of ink ribbon cassette is not possible. Accordingly, in conventional printers, insertion has been carried out while the user holds detecting lever 15 at its central position where ribbon cassette 25 cannot impinge upon central arm 12. However, since ink ribbon printers are often incorporated in business machines such as electronic calculators, ink ribbon cassette 25 must be handled in extremely tight circumstances, therefore presenting many user problems.

These problems in inserting ink ribbon cassette 25 may be overcome in accordance with the invention. Ink cassette housing 25*a* is formed with an opening 25*b* between the respective ribbon spools and a first guide portion 140 and a second guide portion 14 are disposed in opening 25*b* on opposing sides thereof. A corresponding first projection 110 and second projection 11 are provided on the upper portion of projecting lever 15 proximate to shaft 19 for rotating detecting lever 15 to its central position with central arm 12 facing the midpoint of ink ribbon cassette housing 25*a* by the camming action of first guide portion 140 and second guide portion 14 and first projections 110 and second projection 11. Therefore, ink ribbon cassette 25 can be attached easily to ribbon base plate 20 of a printer.

Referring specifically to FIGS. 2 and 3, the embodiment of the invention wherein ink ribbon cassette 25 can be attached to a printer more smoothly are shown. In FIG. 3, wherein the underside of ink ribbon cassette 25 is shown, first ribbon spool 270 and second ribbon spool 27 are shown more clearly. Opening 25*b* formed in ink ribbon cassette housing 25*a* between their respective ink ribbon spools is sufficiently wide for inserting central arm 12 of detecting lever 15 therein. As cassette 25 is inserted, first ribbon-sliding portion 122 on one side of central arm 12 and second ribbon-sliding portion 123 of central arm 12 rides against guide portion 14 and 140 and detecting lever 15 is rotated to the midpoint of ink ribbon cassette 25. In accordance with this embodiment of the invention, ink ribbon cassette 25 is readily attached to ribbon base plate 20 when ink ribbon cassette 25 is maintained substantially parallel to ribbon base plate 20 so that there is substantially no slackness of ink ribbon 26 from either first ink ribbon spool 270 or second ink ribbon spool 27.

When ink ribbon cassette 25 is not parallel to ribbon base plate 20 during insertion, or when some slackness in ink ribbon 26 is present on either side of ink ribbon cassette 25, first ink ribbon-sliding portion 122 or second ribbon-sliding portion 123 of central arm 12 of detecting lever 15 intercepts either first ink ribbon spool 270 or second ink ribbon spool 227 and it is difficult to insert ink ribbon cassette 25 smoothly with a single inserting motion. This inconvenience may also be solved in accordance with the invention as follows. Referring specifically to FIG. 2, central arm 12 of detecting lever 15 is formed with a first edge projection 121 and a second opposed edge projection 120 along central arm 12, the projections formed into circular arc shapes with the free end of central arm 12 flanging outwardly to first ribbon-sliding portion 123 and second ribbon-sliding portion at the end of central arm 12. Central arm 12 constructed and arranged in this manner overcomes the above-noted difficulties encountered in inserting ink ribbon cassette onto ribbon base plate 20.

Figure 4:
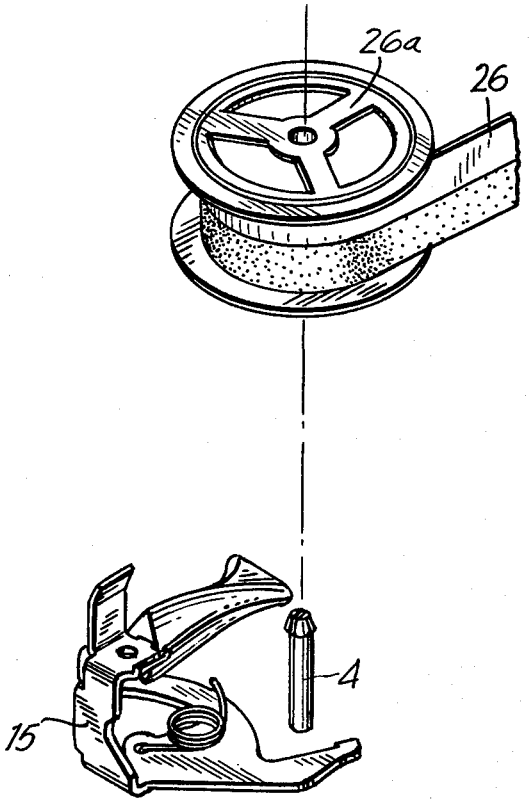
FIG. 4 is an exploded perspective view illustrating the detecting lever of FIGS. 1 and 2 and a conventional ink ribbon spool and shaft.

Ink ribbon cassette 25 can be inserted smoothly onto ink ribbon base plate 20 by a single inserting motion with first side projection 121 sliding about first ink ribbon spool 270 or second side projection 120 sliding about second ink ribbon spool 27 depending on the biasing direction of detecting lever 15 at the time of insertion. Moreover, by providing first side projection 121 and second side projection 120 on central arm 12, a conventional ink ribbon spool 26*a*, shown in FIG. 4, can be inserted on central shaft 3 or 4 and removed in a single motion, thus increasing the utility of detecting lever 15 constructed and arranged in accordance with the invention. Conventional ink ribbon spool 26*a* during winding and reversing functions operates identically to the winding and reversing assembly as described with respect to FIGS. 1 and 2 and need not be repeated in detail here.

Figure 5:
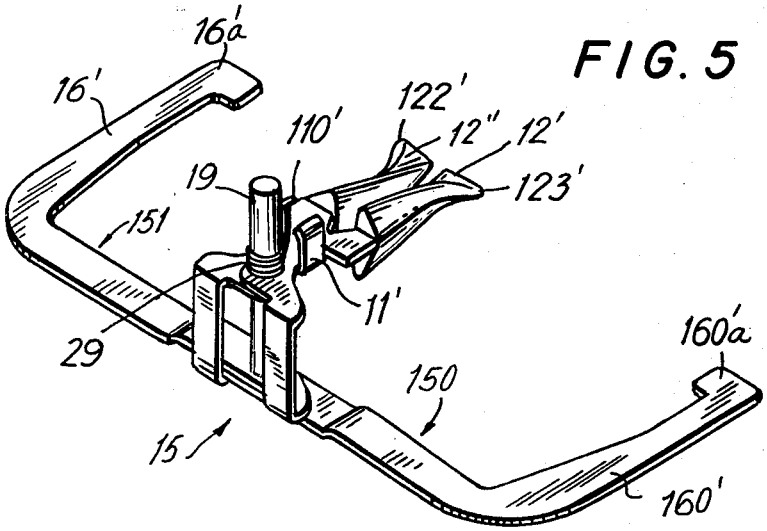
FIG. 5 is a perspective view illustrating a two-piece detecting lever constructed and arranged in accordance with another embodiment of the invention for use in the assembly of FIG. 1.

Referring now to FIG. 5, a detecting lever 15' constructed and arranged in accordance with another embodiment of the invention is shown. Primed numerals are used to describe the identical elements as illustrated with respect to detecting lever 15 shown in FIGS. 1 and 2. These primed elements perform and function in the same manner as with respect to detecting lever 15 and, therefore will not be described in detail. A spring 29 mounted at the base of detecting lever 15' about shaft 19 replaces torsion coil spring 21 and functions in the same manner, however, it is shaped differently as detecting lever 15' is constructed from two separate pieces. A first half 150 of detecting lever 15' includes a first half of central arm 12' and a first wing 160' formed with a reversing projection 160*a'* and a second half of detecting lever 15' includes a second half of a central arm 12'' and a wing 16' formed with a reversing projection 16*a'*.

By constructing and arranging an ink ribbon winding and reversing assembly in accordance with the invention, the ink ribbon winding and reversing operations may be performed in an improved manner. In addition, conventional ink ribbon spools and ink ribbon cassettes having two ink ribbon spools rotatably mounted therein can be attached to and removed from the winding and reversing assembly by a single motion. Moreover, the construction of the assembly is simplified, lending itself to miniaturization for use in small electronic calculators and the like.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An ink ribbon winding and reversing assembly comprising:

a first and a second rotatably mounted ratchet wheel spaced apart from each other;

winding means for selectively operatively engaging one of said ratchet wheels to become the first winding ratchet wheel to drive said ratchet wheel in a first winding direction;

detecting means operatively engaged with the second ratchet wheel for selectively detecting completion of unwinding from said second ratchet wheel; and reversing means for reversing winding direction by operatively engaging said winding means with said second ratchet wheel to become the winding ratchet wheel to drive said second ratchet wheel in a second winding direction;

said detecting means operatively coupled to said winding means for reversing engagement of said winding means from said first ratchet wheel to said second ratchet wheel and for reversing engagement of said detecting means from said second ratchet wheel to said first ratchet wheel upon detecting completion of winding; and said detecting means including projecting means for aligning said detecting means when an ink ribbon cassette having two ink ribbon spools rotatably mounted therein is being mounted on said assembly, said projecting means extending into the interior of said cassette in the region between said spools, said cassette including cooperating guide surfaces in the region between said spools for engaging said projecting means, whereby said detecting means is displaced to a neutral position substantially at the midpoint of the spools.

2. The assembly of claim 1, wherein said detecting means includes guide means adapted to receive an ink ribbon spool in a camming fashion when an ink ribbon spool is mounted on said ratchet wheels.

3. The assembly of claim 1, including anti-reversal means operatively coupled to said detecting means and said winding means for preventing unwinding of said winding ratchet wheel during winding thereof by said winding means.

4. The assembly of claim 1, wherein said winding means includes feeding means for selectively operatively engaging one of said ratchet wheels to become the winding ratchet wheel to drive said winding ratchet wheel in a first winding direction and driving means operatively coupled to said feeding means for displacing said feeding means for driving said winding ratchet wheel in its respective winding direction.

5. The assembly of claim 4, wherein said feeding means is a feeding lever selectively operatively engaging one of said ratchet wheels for winding said ratchet wheel in its respective winding direction, said driving means for driving said feeding lever.

6. The assembly of claim 5, wherein said feeding lever is an elongated lever disposed between said ratchet wheels and formed with two opposed feeding pawls for selectively engaging said associated ratchet wheel to drive said engaged ratchet wheel in its respective winding direction.

7. The assembly of claim 6, wherein said feeding lever is displaced between a first position out of engagement with said winding ratchet wheel and a second position in engagement with said ratchet wheel for driving said ratchet wheel in said winding direction, said feeding lever reciprocatively displaced by said driving means.

8. The assembly of claim 7, wherein said feeding lever is adapted to be pivoted between a first position in selective operative engagement with one of said ratchet wheels which is the winding ratchet wheel and a second position in selective operative engagement with the other of said ratchet wheels to become the winding ratchet wheel in response to said detecting means detecting completion of winding in one of said winding directions.

9. The assembly of claim 8, including biasing means for biasing said feeding lever towards said winding ratchet wheel.

10. The assembly of claim 7, wherein said driving means is a reciprocating elongated driving lever pivotally mounted to said feeding lever for displacing said feeding lever between its first position and its second position for winding said ratchet wheels.

11. The assembly of claim 10, including biasing means for biasing said feeding lever toward said winding ratchet wheel, and said biasing means is a coil spring mounted between said driving lever and said feeding lever.

12. The assembly of claim 6, wherein said reversing means includes two opposed reversing pawls formed on said feeding lever and disposed for selectively operatively engaging said detecting means upon completion of winding in one of said winding directions.

13. The assembly of claim 6, wherein said detecting means includes cam means for engaging the outer surface of an ink ribbon wound on an ink ribbon spool associated with the unwinding ratchet wheel, said detecting means biased towards said unwinding ratchet wheel.

14. The assembly of claim 13, wherein said detecting means is a pivotally mounted detecting lever formed with an elongated central arm formed with opposed ribbon-sliding portions at the free end thereof disposed between said ratchet wheels, said detecting lever biased towards said unwinding ratchet wheel, one of said ribbon-sliding portions adapted to slide on the outer surface of an ink ribbon unwinding from an ink ribbon spool associated with said unwinding ratchet wheel.

15. The assembly of claim 14, wherein said detecting lever is displaced between a first position towards said unwinding ratchet wheel and a second position towards said other ratchet wheel at completion of winding on said other ratchet wheel in response to pivoting of said feeding lever between its first position and its second position.

16. The assembly of claim 15, wherein said detecting lever is formed further with two outer wing portions extending towards said ratchet wheels, said wing portions adapted to enter the locus of said reciprocating feeding lever at completion of winding on the winding ratchet wheel whereby said feeding lever is rotated toward its second position in operative engagement with said other ratchet wheel which becomes the winding ratchet wheel and said detecting lever rotated to its second position with said other ribbon-sliding portion of said central arm engaging the outer surface of the ink ribbon unwinding from a ribbon spool associated with said unwinding ratchet wheel.

17. The assembly of claim 16, including biasing means for biasing said detecting lever towards said unwinding ratchet wheel.

18. The assembly of claim 16, including anti-reversing means for preventing unwinding of said winding ratchet wheel when driven by the reciprocative movement of said feeding lever.

19. The assembly of claim 18, wherein said anti-reversal means is an anti-reversing lever disposed between said ratchet wheel, formed with two opposed anti-reversal pawls adapted to engage said ratchet wheels for preventing unwinding of said winding ratchet wheel when said feeding lever is displaced toward its first position out of winding engagement therewith.

20. The assembly of claim 19, wherein each said anti-reversal pawl includes a reversal projection and said feeding lever includes an anti-reversal arm disposed between said pawls for engaging one of said reversal projections to displace said anti-reversal lever towards the other ratchet wheel when said feeding lever is displaced at conclusion of winding.

21. The assembly of claim 17, including biasing means for biasing said detecting lever toward its first position and said anti-reversal lever towards said winding ratchet wheel, and said biasing means is a coil spring mounted between said detecting lever and said anti-reversing lever.

22. The assembly of claim 2, wherein said detecting means includes a rotatable detecting lever formed with an elongated central arm disposed between said ratchet wheels, said central arm formed with opposed arc shaped projections on the sides thereof adapted to displace said detecting lever about a ribbon spool being mounted on one of said ratchet wheels.

23. The assembly of claim 1, wherein said detecting means includes a rotatable detecting lever formed with an elongated central arm disposed between said ratchet wheels, said detecting lever formed with two opposed guide projections for facilitating insertion of an ink ribbon cassette into engagement with said assembly.

24. An ink ribbon cassette for use in an ink ribbon winding and reversing assembly in a printer including detecting means for reversing ribbon winding direction, said cassette comprising a cassette housing having two ink ribbon spools rotatably mounted in said housing and including two opposed arm portions extending substantially parallel outward from each ink ribbon spool, said ink ribbon wound from one ink ribbon spool through one of said arm portions to said other arm portion, an exposed length of ink ribbon therebetween, and wound through said second arm portion to said other ink ribbon spool; said housing portion including an opening between said ink ribbon spools for receiving and detecting means of the ribbon winding and reversing assembly, and said opening in said cassette housing including inwardly facing opposed guide surfaces for receiving and guiding upwardly extending projections on the detecting means of the winding and reversing assembly when said cassette is being mounted on the assembly; whereby the detecting means extends into the cassette.

25. In an ink ribbon winding and reversing assembly in a printer including a first and a second rotatably mounted ratchet wheel spaced apart from each other and winding means operatively engaged with one of said ratchet wheels for winding an ink ribbon thereon, the improvement which comprises a detecting lever comprising an elongated central arm extending between said ratchet wheels having ribbon-sliding portions on the opposed side edges thereof for riding on the outer surface of an unwinding ink ribbon and two outer elongated wing portions extending substantially parallel to said central arm, one of said wing portions engageable with said winding means at completion of winding in one direction for selectively engaging said winding means with the other of said ratchet wheels and upwardly extending projections for aligning said detecting lever to a position intermediate to said ratchet wheels when an ink ribbon cassette including two ink ribbon spools is being mounted on the assembly; whereby said detecting lever extends into the cassette.

26. An ink ribbon cassette comprising a cassette housing having two ink ribbon spools rotatably mounted in said housing and including two opposed arm portions extending substantially parallel outward from each side of said housing, said housing portion including an opening between said ink ribbon spools for receiving a displaceable detecting means of an ink ribbon winding and reversing assembly, said opening in said cassette housing including inwardly facing opposed guide surfaces for receiving and guiding the detecting means for the winding and reversing assembly to the center of said housing by engaging projections formed on the detecting means in camming fashion, when said cassette is being mounted on an ink ribbon and winding assembly; whereby said detecting means extends into the cassette between the ribbon spools.

* * * * *